US012091879B1

(12) United States Patent
Abbas et al.

(10) Patent No.: US 12,091,879 B1
(45) Date of Patent: Sep. 17, 2024

(54) BEAM-COLUMN MOMENT CONNECTION STRUCTURE

(71) Applicant: KING SAUD UNIVERSITY, Riyadh (SA)

(72) Inventors: Husain Sayyed Abbas, Riyadh (SA); Mohammed Abdulkhaleq Alrubaidi, Riyadh (SA); Yousef Abdullah AlSalloum, Riyadh (SA); Hussein Mohamed Elsanadedy, Riyadh (SA); Tarek H. Amusallam, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 18/602,307

(22) Filed: Mar. 12, 2024

(51) Int. Cl.

| | |
|---|---|
| ***E04H 9/14*** | (2006.01) |
| ***E04B 1/98*** | (2006.01) |
| ***E04H 9/02*** | (2006.01) |
| ***E04H 9/04*** | (2006.01) |
| *E04B 1/24* | (2006.01) |
| *E04C 3/06* | (2006.01) |

(52) U.S. Cl.
CPC ..... *E04H 9/021* (2013.01); *E04H 9/024* (2013.01); *E04H 9/04* (2013.01); *E04H 9/14* (2013.01); *E04B 1/24* (2013.01); *E04B 1/2403* (2013.01); *E04B 1/98* (2013.01); *E04C 3/06* (2013.01)

(58) Field of Classification Search
CPC . E04B 1/98; E04B 1/24; E04B 1/2403; E04B 2001/2415; E04B 2001/2445; E04C 3/06; E04H 9/021; E04H 9/024; E04H 9/04; E04H 9/14
See application file for complete search history.

(56) References Cited

U.S. PATENT DOCUMENTS

| | | | | |
|---|---|---|---|---|
| 3,144,105 A * | 8/1964 | Capek | E04B 1/2403 403/387 |
| 5,660,017 A * | 8/1997 | Houghton | E04H 9/024 52/283 |
| 6,474,902 B1 * | 11/2002 | Beauvoir | E04B 1/2403 403/403 |
| 6,837,016 B2 | 1/2005 | Simmons et al. | |

(Continued)

FOREIGN PATENT DOCUMENTS

| | | |
|---|---|---|
| CN | 215977694 U | 3/2022 |
| CN | 217679649 U | 10/2022 |
| WO | 9618774 A1 | 6/1996 |

*Primary Examiner* — Phi D A
(74) *Attorney, Agent, or Firm* — Nath, Goldberg & Meyer; Joshua B. Goldberg

(57) ABSTRACT

The beam-column moment connection structure provides secure connection between structural beams and columns, such as conventional I-beams. A first bolt is secured to an upper beam flange at a second end of a beam, where the first bolt extends laterally. Similarly, a second bolt is secured to the lower beam flange at the second end of the beam and also extends laterally. A first block is secured to an exterior face of a first column flange of the column and has a first slot formed therein. Similarly, a second block is secured to the exterior face of the first column flange and has a laterally extending second slot formed therein. The first and second blocks are spaced apart and configured such that the first bolt is received in the first slot and the second bolt is received in the second slot to secure the beam to the column.

17 Claims, 12 Drawing Sheets

(56) References Cited

U.S. PATENT DOCUMENTS

| | | | | |
|---|---|---|---|---|
| 7,146,770 | B2 | 12/2006 | Simmons | |
| 7,497,054 | B2 | 3/2009 | Takeuchi et al. | |
| 8,123,001 | B1 * | 2/2012 | Apostolopoulos | E04G 3/30 182/150 |
| 8,375,652 | B2 * | 2/2013 | Hiriyur | E04H 9/024 52/657 |
| 8,898,992 | B2 * | 12/2014 | Rahimzadeh | E04B 1/30 52/745.15 |
| 10,000,919 | B2 * | 6/2018 | Oba | E04B 1/2403 |
| 10,626,595 | B2 * | 4/2020 | Ramezani | E04B 1/2403 |
| 10,900,215 | B1 * | 1/2021 | Alrubaidi | E04H 9/024 |
| RE48,705 | E | 8/2021 | Houghton et al. | |
| 11,162,260 | B2 * | 11/2021 | Pryor | E04H 9/024 |
| 11,299,880 | B2 * | 4/2022 | Pryor | E04B 1/24 |
| 11,332,348 | B2 * | 5/2022 | Peippo | E04B 1/2403 |
| 11,598,086 | B2 * | 3/2023 | Onishi | E04B 1/5812 |
| 11,680,399 | B2 * | 6/2023 | Houston | E04B 1/2403 52/838 |
| 11,773,593 | B1 | 10/2023 | Abbas et al. | |
| 11,808,026 | B2 * | 11/2023 | Zhao | E04B 1/2403 |
| 2006/0144006 | A1 * | 7/2006 | Suzuki | E04H 9/024 52/655.1 |
| 2015/0275501 | A1 * | 10/2015 | Houghton | E04H 9/024 52/854 |

* cited by examiner

BEAM-COLUMN MOMENT CONNECTION STRUCTURE

BACKGROUND

Field

The disclosure of the present patent application relates to structural joints, and particularly to a joint for a beam-column connection for improving the resistance of steel-framed buildings against progressive collapse.

Description of Related Art

Building frames, such as typical steel building frames, are often exposed to extreme load events, such as those caused by large wind forces, earthquakes and blast loads. The ability of steel to resist yielding under external forces is one of the reasons that steel is seen as an ideal building material for structural frames, however, steel buildings are still susceptible, under extreme conditions, to progressive collapse due to exposure to blast loads. The performance of steel-framed buildings primarily depends on the behavior of the frame's beam-column joints. The properties of the joints are crucial in a steel-framed building, since they determine the constructability, stability, strength, flexibility, residual forces, and ductility of the overall structure.

Progressive collapse is the propagation of an initial local failure from one part of the building to the adjoining parts, resulting in the eventual collapse of the entire building or, at least, large parts thereof. Strengthening joints to resist progressive collapse is of particular importance in the design of building frames. In steel building frames, both "shear connections" and "moment connections" are commonly used. A moment connection is a connection which has the capacity to transfer moment between the structural members. Shear connections are connections which are able to transfer only shear force between the bridging members. Since moment connections can transfer moment between the child members, the relative rotation is restricted, which is not the case for shear connections.

Moment connections are particularly used in situations where beam or column splicing in zones with non-zero bending moment is necessary or in cases where a high degree of structural indeterminacy is desired. For example, steel frames rigidly connected at the base present higher stiffness and strength than pin-supported frames and are therefore subjected to much lower deflections at the serviceability limit state. The detailing of moment connections is typically performed using either bolts or weldings. Bolted moment connections can be created using beam endplates combined with bolts which work primarily under tension/compression. Further, L-shaped plates are commonly fixed to the flanges of the child members using bolts, which must be designed to take the shear force generated by the tension/compression forces in the flanges. Welded moment connections are performed using partial of full penetration butt welds, which offer high rigidity but require careful inspection. For this reason, welded connections are primarily constructed in the factory.

Moment connection detailing entails additional erection cost when compared to shear connections. Further, as noted above, particularly for welded connections, most moment connections are manufactured off-site. It would be desirable to be able to create moment connections on-site, which will reduce the overall costs of both manufacture and transport.

Thus, a beam-column moment connection structure solving the aforementioned problems is desired.

SUMMARY

The beam-column moment connection structure provides a secure connection between structural beams and columns, such as, but not limited to, conventional I-beams. The beam has a beam web, an upper beam flange, a lower beam flange, and first and second longitudinally opposed ends. A first bolt is secured to the upper beam flange at the second end of the beam, where the first bolt extends laterally; i.e., perpendicular to the longitudinal direction in which the beam extends. Similarly, a second bolt is secured to the lower beam flange at the second end of the beam and also extends laterally.

The column has a column web, a first column flange and a second column flange. A first block is secured to an exterior face of the first column flange and has a first slot formed therein. Similarly, a second block is secured to the exterior face of the first column flange and has a laterally extending second slot formed therein. The first and second blocks are spaced apart and configured such that the first bolt is received in the first slot and the second bolt is received in the second slot to secure the beam to the column.

First and second locking members may be provided for locking the first and second bolts in the first and second slots, respectively. Each of the first and second blocks may have laterally opposed first and second ends, with the first end being open to receive the respective bolt and the second end being closed. Upper and lower lips may be respectively formed on upper and lower portions of the first end of each of the first and second blocks, and each of the first and second locking members may have a substantially C-shaped contour for receiving and mating with the first end and the upper and lower lips of each of the first and second blocks.

The beam web may have first and second recesses formed therein at the second end of the beam for partially receiving the first and second blocks, respectively. Additionally, at least one first stiffener plate may be secured to the first column flange and the first block, and at least one second stiffener plate may be secured to the first column flange and the second block. Further, a shear plate may be secured to the first column flange, extending longitudinally therefrom, such that the shear plate is attached to the beam web at the second end of the beam.

In an alternative embodiment, the first bolt and the second bolt may be cylindrical (or elliptical) bolts and the first and second laterally extending slots may each be cylindrical (or elliptical) slots for slidably receiving and mating with the first and second bolts. To take care of the lack of fit, the bolts and the corresponding slots may have slight taper. Each of the first and second blocks may further have a longitudinally extending slot in open communication with the corresponding one of the first and second laterally extending slots for receiving portions of the upper and lower beam flanges, respectively. In this embodiment, additional locking members are not required and both of the laterally opposed ends of each of the first and second blocks may be open.

These and other features of the present subject matter will become readily apparent upon further review of the following specification.

BRIEF DESCRIPTION OF DRAWINGS

Similar reference characters denote corresponding features consistently throughout the attached drawings.

DETAILED DESCRIPTION

Figure 1:
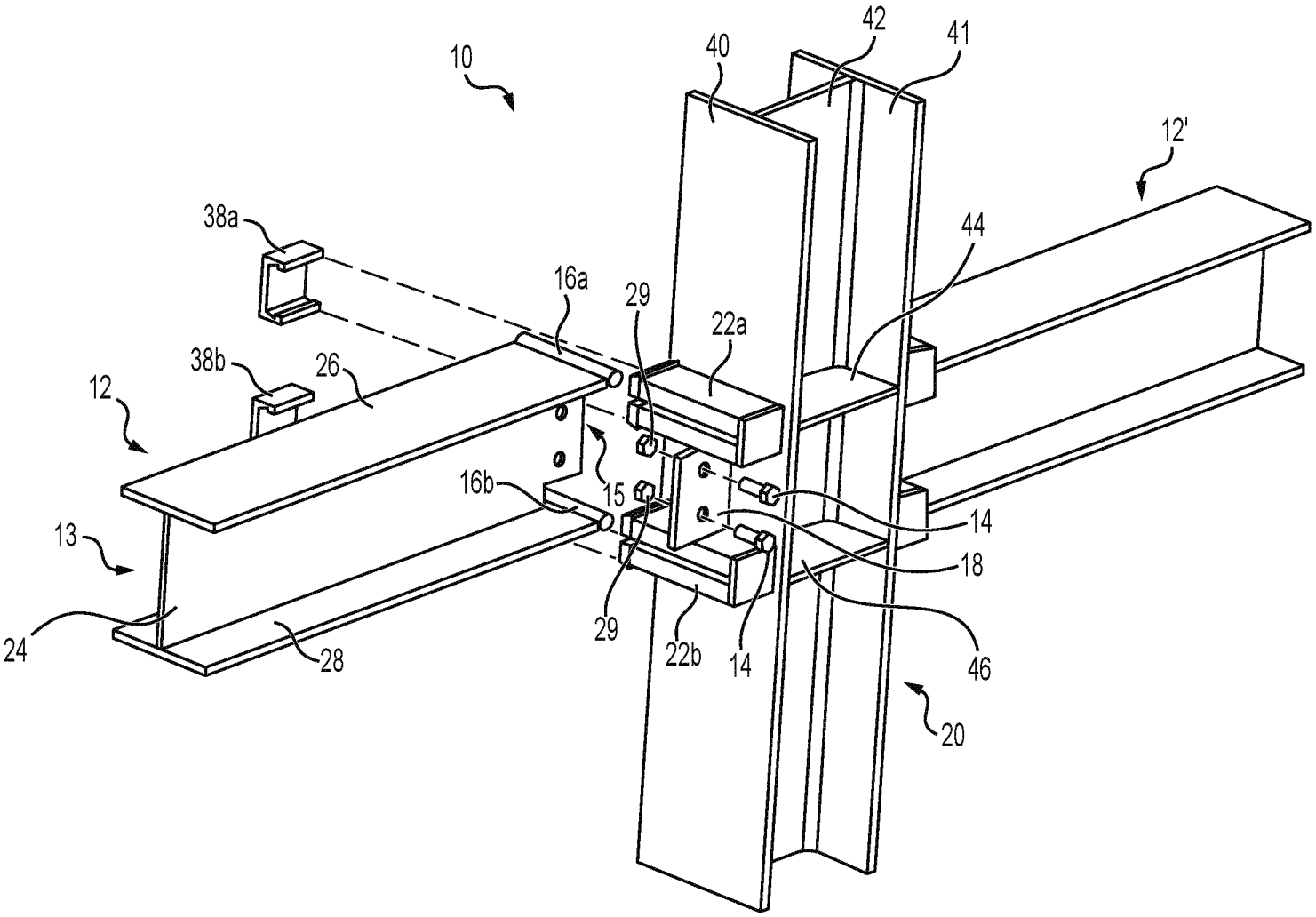
FIG. 1 is a partially exploded, perspective view of a beam-column moment connection structure.

The beam-column moment connection structure 10 provides secure connection between structural beams and columns, such as, but not limited to, conventional I-beams. In the non-limiting example of FIG. 1, beam 12 is a conventional I-beam having a beam web 24, an upper beam flange 26, a lower beam flange 28, and first and second longitudinally opposed ends 13 and 15, respectively. A first bolt 16*a* is secured to the upper beam flange 26 at the second end 15 of the beam 12, where the first bolt 16*a* extends laterally; i.e., perpendicular to the longitudinal direction in which the beam 12 extends. In the orientation shown in FIG. 1, the lateral direction is also perpendicular to the vertical direction in which column 20 extends. Similarly, a second bolt 16*b* is secured to the lower beam flange 28 at the second end 15 of the beam 12 and also extends laterally. It should be understood that any suitable type of bolts or similar structural elements may be used. The first and second bolts 16*a*, 16*b* may be secured to the corresponding beam flanges 26, 28 by welding or the like. The tensile strength of the welds should be equal to the tensile strength of the corresponding beam flange 26, 28.

Figure 2A:
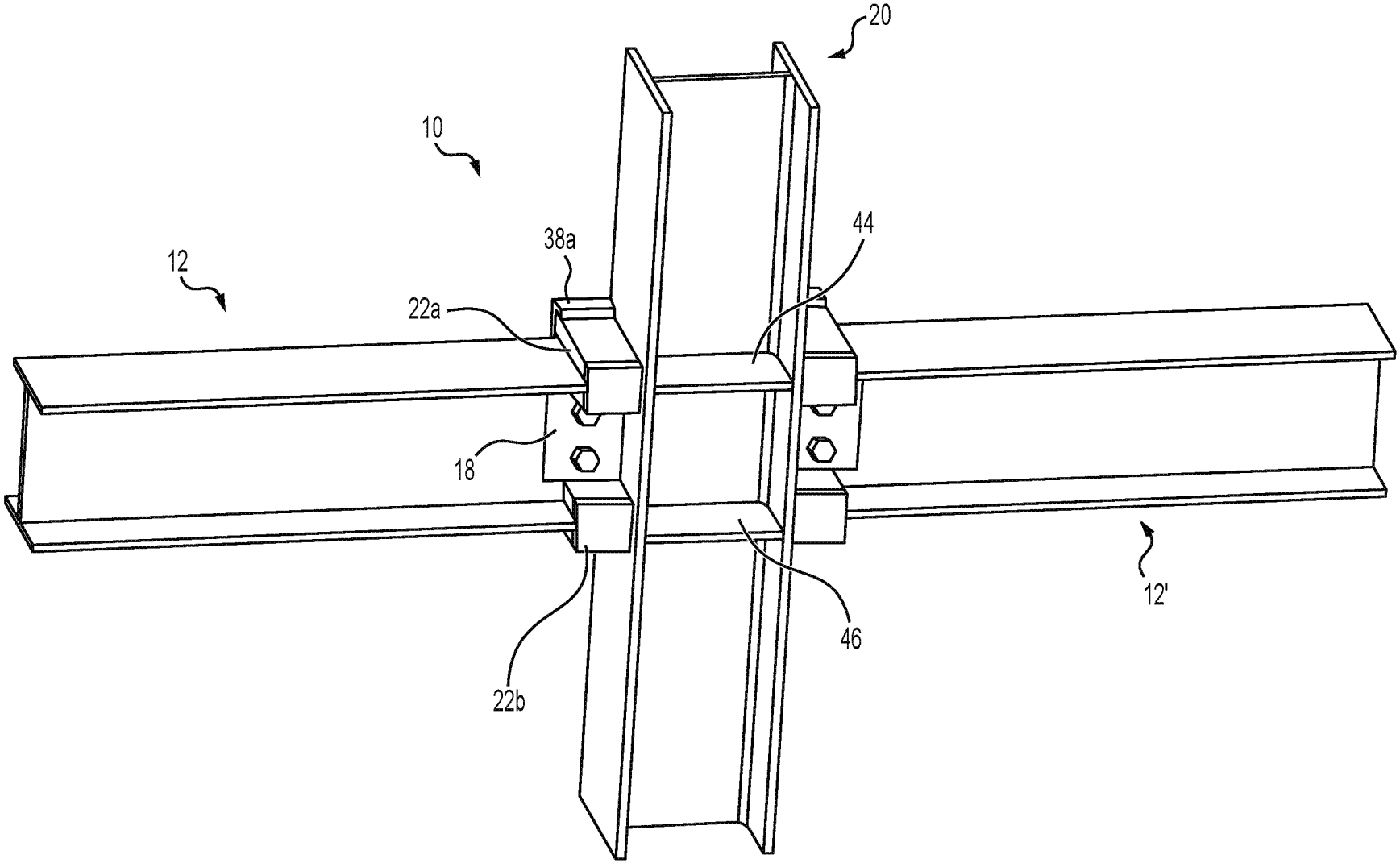
FIG. 2A is a perspective view of the beam-column moment connection structure.
Figure 3:
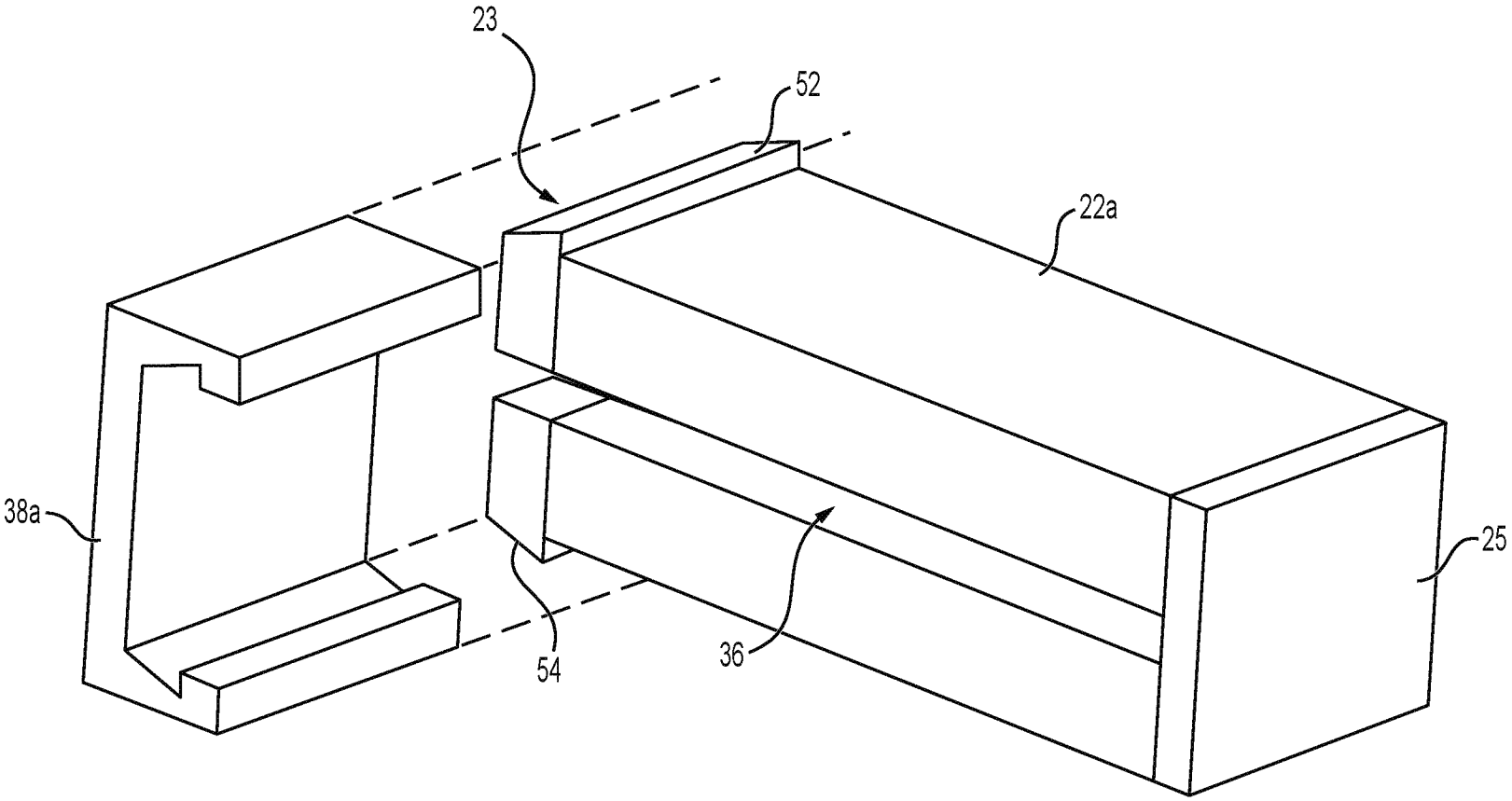
FIG. 3 is a perspective view of a block of the beam-column moment connection structure.

In the non-limiting example of FIGS. 1 and 2A, column 20 is also a conventional I-beam having a column web 42, a first column flange 40 and a second column flange 41. A first block 22*a* is secured to an exterior face of the first column flange 40 and, as best seen in FIG. 3, has a first slot 36 formed therein. Similarly, a second block 22*b* is secured to the exterior face of the first column flange 40. Second block 22*b* is constructed identically to first block 22*a* and also has a laterally extending second slot formed therein. The first and second blocks 22*a*, 22*b* are spaced apart and configured such that the first bolt 16*a* is received in the first slot 36 of first block 22*a* and the second bolt 16*b* is received in the second slot of second block 22*b* to secure the beam 12 to the column 20. The laterally extending slots have a further internal cylindrical cavity or recess for securely receiving and mating with the respective bolts. To take care of the lack of fit, the first and second bolts and the corresponding first and second slots may have slight taper. The first and second blocks 22*a*, 22*b* may be welded to the first column flange 40. The weld should be strong enough to resist the tensile force transmitted through beam flanges 26, 28. The welded connection of each of first and second blocks 22*a*, 22*b* should also be capable of resisting forces arising during progressive collapse.

First and second locking members 38*a* and 38*b*, respectively, may be provided for locking the first and second bolts 16*a*, 16*b* in the first and second slots, respectively. As shown in FIG. 3, the first block 22*a* has laterally opposed first and second ends 23, 25, respectively, with the first end 23 being open to receive the first bolt 16*a* and the second end 25 being closed. Upper and lower lips 52, 54, respectively, may be respectively formed on upper and lower portions of the first end 23 of the first block 22*a*, and the first locking member 38*a* may have a substantially C-shaped contour for receiving and mating with the first end 23 and the upper and lower lips 52, 54. As noted above, second block 22*b* is constructed identically to first block 22*a*. Similarly, the second locking member 38*b* is constructed identically to the first locking member 38*a* and functions in an identical manner. In FIGS. 1 and 2A, a second beam 12' is also shown, and it should be understood that second beam 12' may be connected to column 20 with an identical beam-column moment connection structure 10. Locking members 38*a*, 38*b* may be made from steel or the like. During connection of beam 12 to column 20, the beam 12 is pushed in the lateral direction such that the bolts 16*a*, 16*b* are inserted into the slots of the first and second blocks 22*a*, 22*b* simultaneously. Once the beam 12 is in position, the locking members 38*a*, 38*b* are locked in place to hold the bolts 16*a*, 16*b* within the first and second blocks 22*a*, 22*b*, respectively. The slots of the first and second blocks 22*a*, 22*b* may be shaped to slidingly receive and mate with the respective bolts 16*a*, 16*b*. As a non-limiting example, each slot may include a laterally-extending, central, cylindrically-shaped cavity or recess for receiving the cylindrical bolts 16*a*, 16*b*.

Figure 2B:
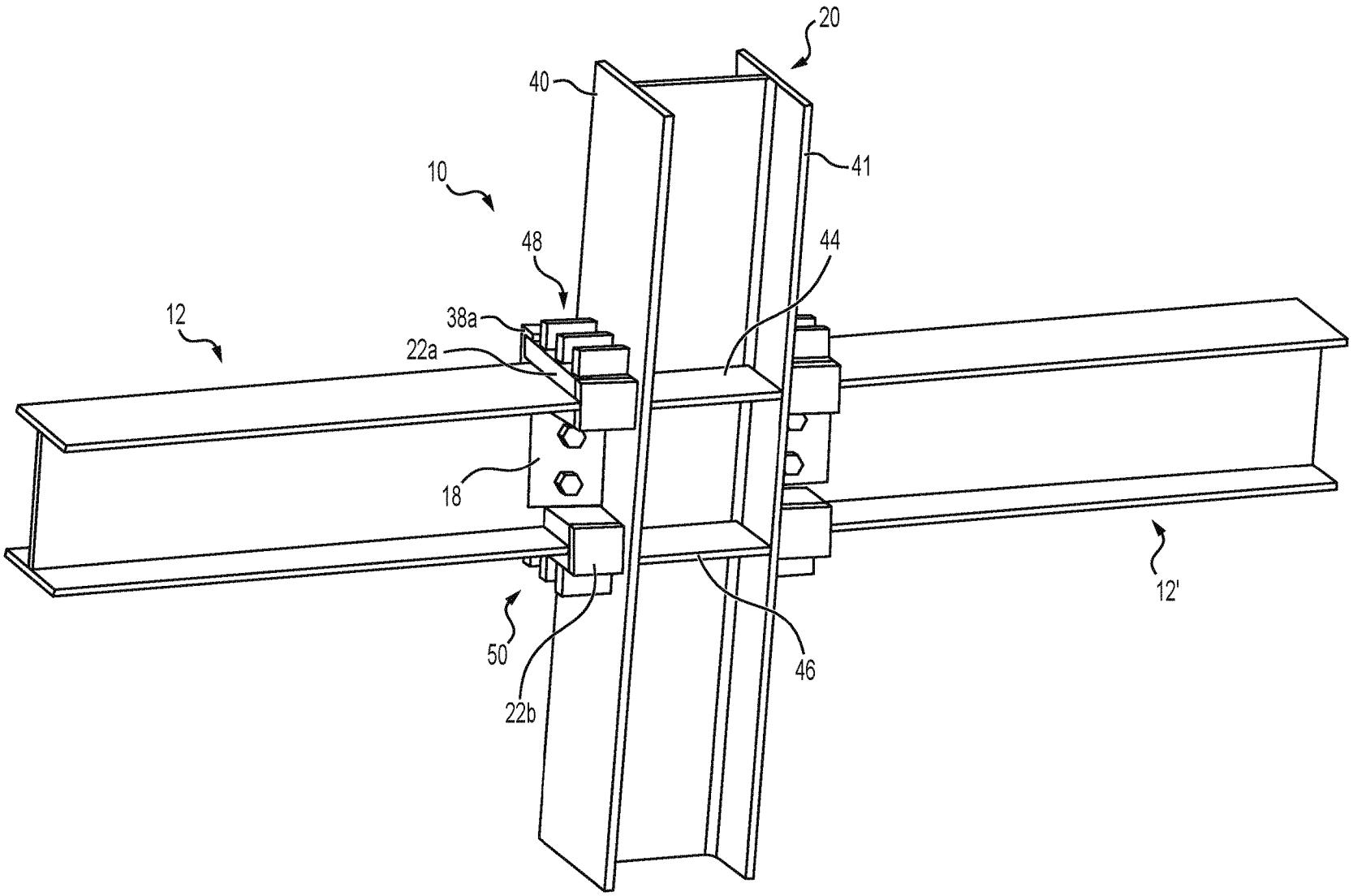
FIG. 2B is a perspective view of the beam-column moment connection structure with additional stiffeners.
Figure 4:
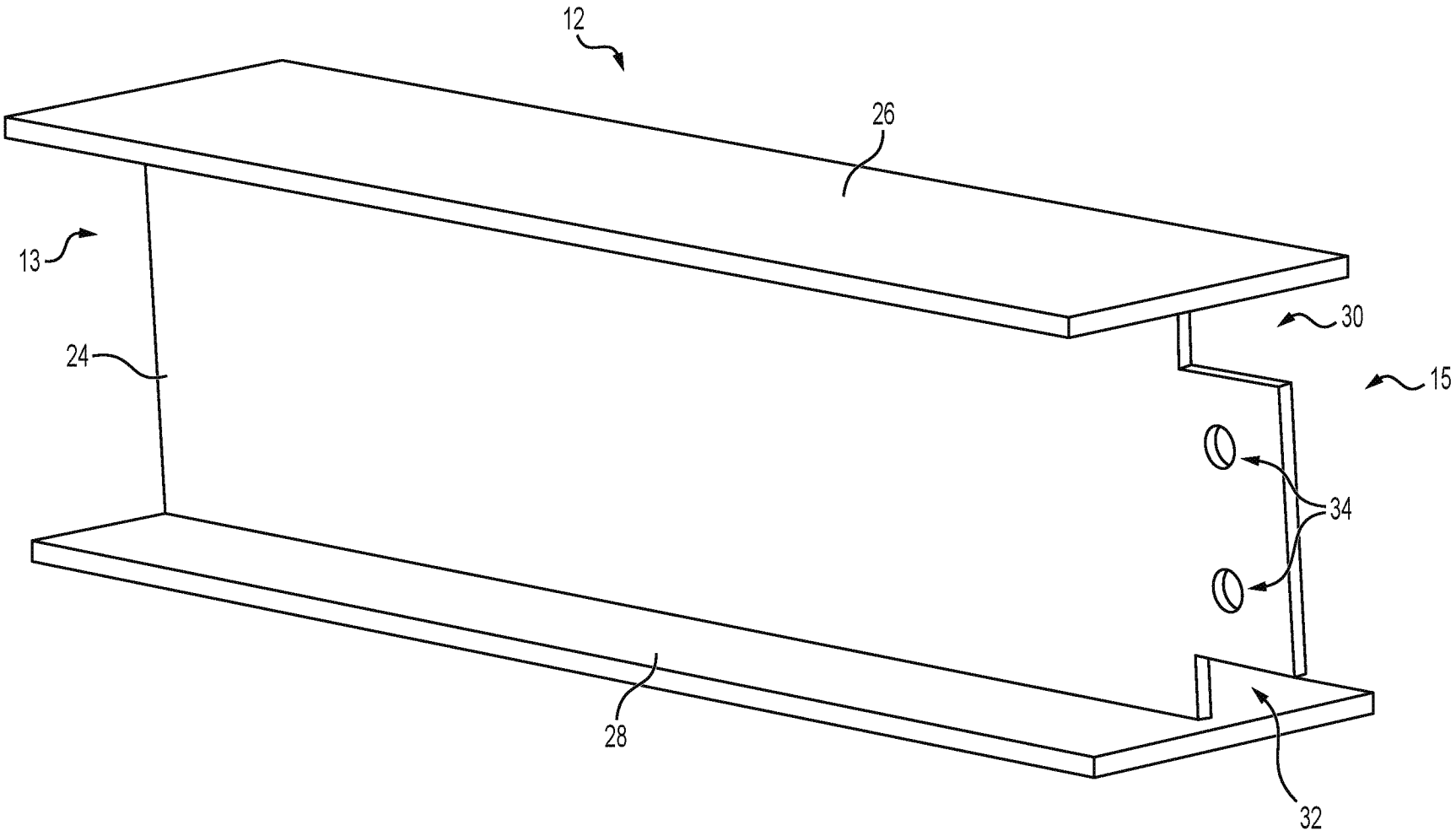
FIG. 4 is a perspective view of a beam of the beam-column moment connection structure.

As shown in FIG. 4, the beam web 24 may have first and second recesses 30, 32, respectively, formed therein at the second end 15 of the beam 12 for partially receiving the first and second blocks 22*a*, 22*b*, respectively. Additionally, as shown in FIG. 2B, at least one first stiffener plate 48 may be secured to the first column flange 40 and the first block 22*a*, and at least one second stiffener plate 50 may be secured to the first column flange 40 and the second block 22*b*. It should be understood that the three first stiffener plates 48 and the three second stiffener plates 50, as well as their rectangular shapes, are shown for exemplary purposes only, and that the stiffener plates may be provided in any suitable number and shape.

Further, as shown in FIGS. 1 and 2A, a shear plate 18 may be secured to the first column flange 40, extending longitudinally therefrom, such that the shear plate 18 is attached to the beam web 24 at the second end 15 of the beam 12. In the non-limiting example of FIGS. 1, 2A and 4, a pair of openings 34 are formed through the beam web 24 at the second end 15 of the beam 12 for receiving a corresponding pair of threaded bolts 14, which also pass through corresponding openings formed through shear plate 18. The shear plate 18 may be secured to the beam web 24 by the threaded bolts 14 and corresponding nuts 29. It should be understood that threaded bolts 14 and nuts 29 are shown for exemplary purposes only and that any suitable type of attachment may be used. Similarly, it should be understood that the number of bolts 14 and corresponding nuts 29 are shown for exemplary purposes only, and that any suitable number of bolts or other attachments may be provided. The shear connection between the beam web 24 and the column 20 helps in the transfer of shear force from the beam 12 to the column 20. The number and diameter of holes formed through web 24 and shear plate 18 may be selected based on the shear capacity of the beam web 24.

Figure 5:
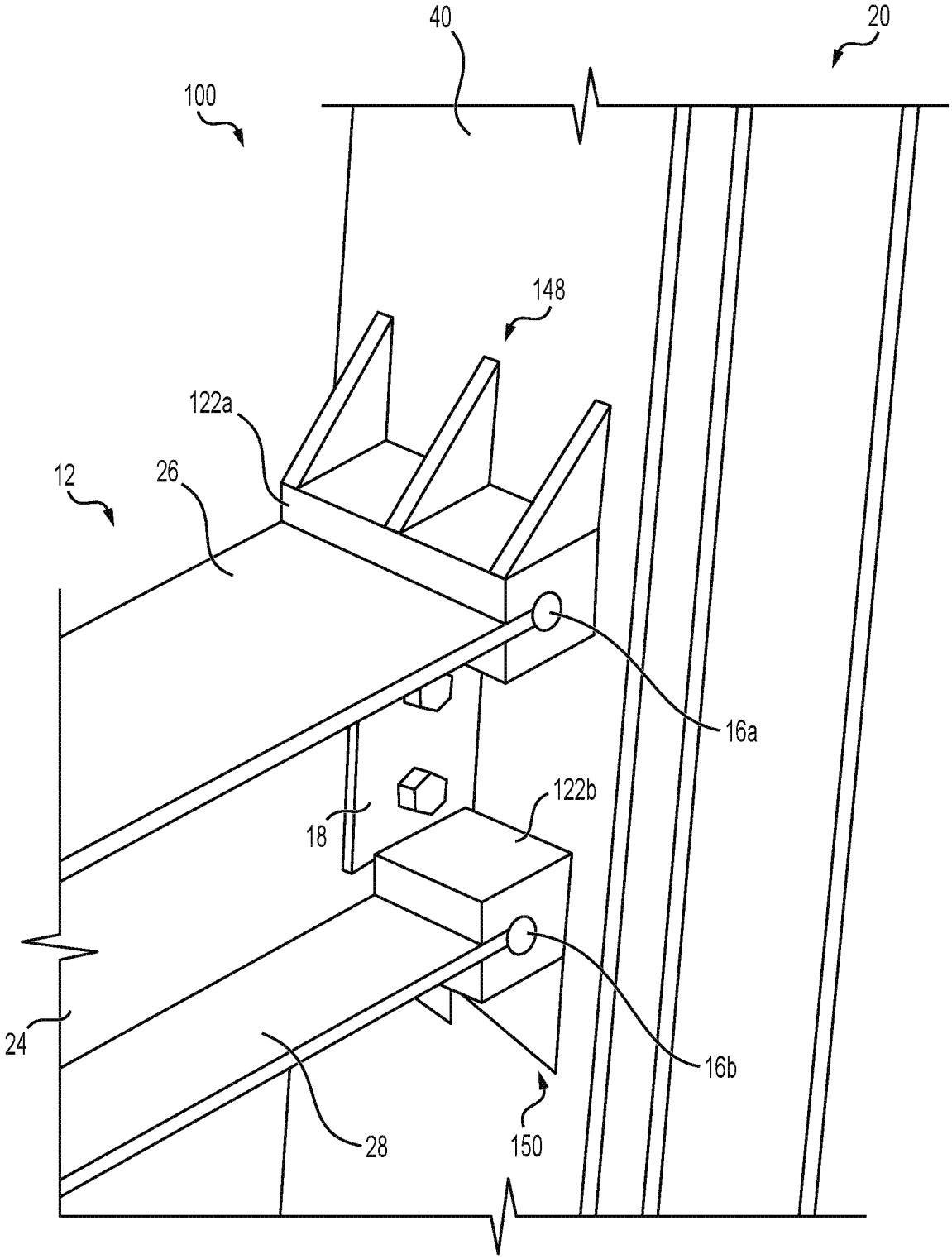
FIG. 5 is a partial perspective view of an alternative embodiment of the beam-column moment connection structure.
Figure 6:
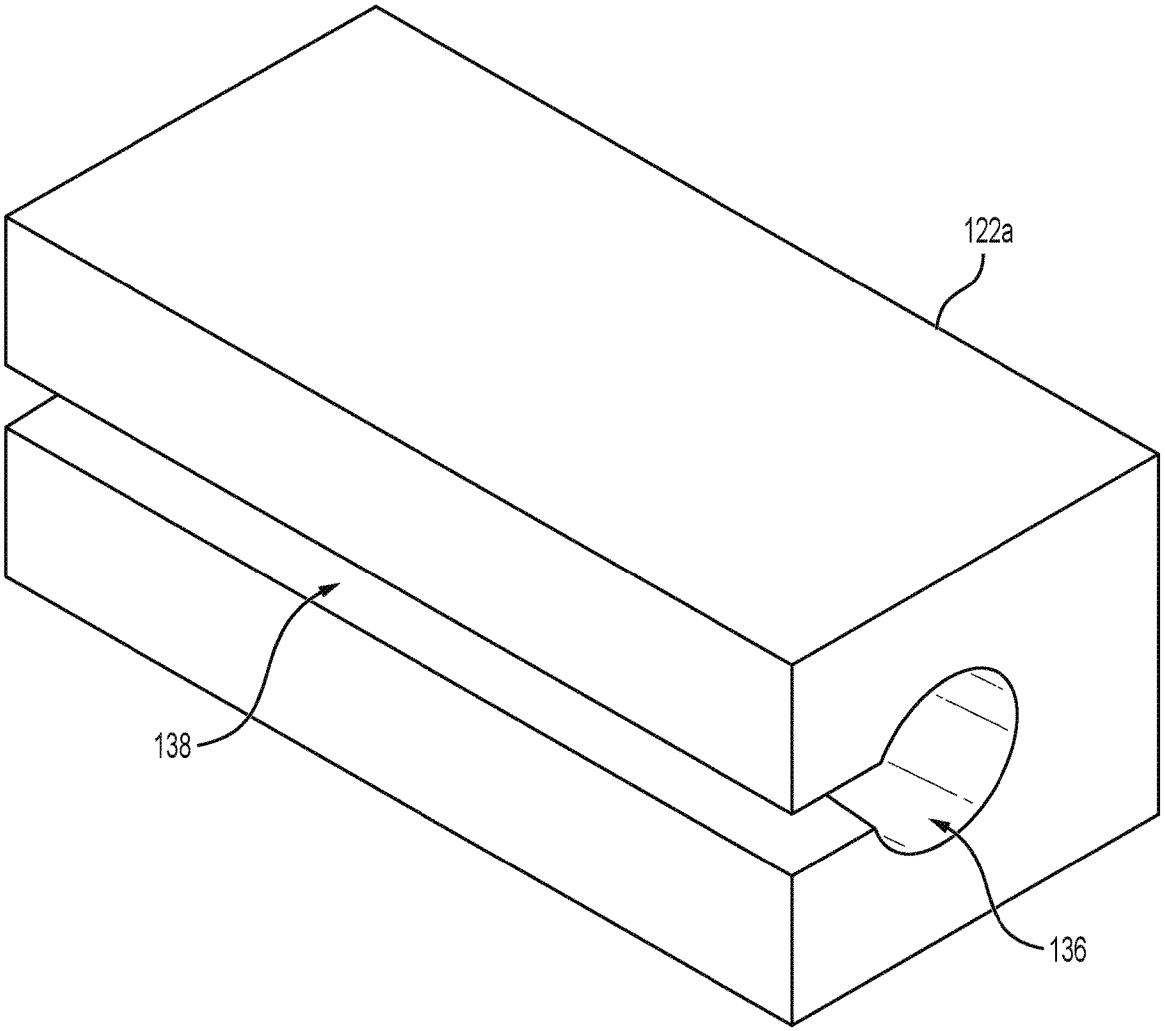
FIG. 6 is a perspective view of a block of the beam-column moment connection structure of FIG. 5.

In the alternative embodiment of FIG. 5, the beam-column moment connection structure 100 includes first and second bolts 16*a*, 16*b*, similar to the previous embodiment, but both the first and second bolts 16*a*, 16*b* are cylindrical bolts. Correspondingly, the first and second laterally extending slots formed through each of first and second blocks 122*a*, 122*b* are cylindrical slots for slidably receiving and mating with the first and second bolts 16*a*, 16*b*. FIG. 6 shows first block 122*a* and it should be understood that second block 122*b* is constructed identically. As shown, the first block 122*a* also includes a longitudinally extending slot 138 in open communication with the laterally extending slot 136. As shown in FIG. 5, the longitudinally extending slot 138 receives a portion of the upper beam flange 26. The lower beam flange 28 is partially received in the identical longitudinally extending slot of the second block 122*b*. In this embodiment, as shown in FIG. 5, additional locking members are not required and both of the laterally opposed ends of each of the first and second blocks 122*a*, 122*b* may be open.

Additionally, as discussed above with respect to FIG. 2B, it should be understood that the number and shape of the stiffener plates are shown for exemplary purposes only and may be varied. In the non-limiting example of FIG. 5, three upper triangular stiffener plates 148 and corresponding lower triangular stiffener plates 150 are shown.

It should be understood that the beam-column moment connection structure is not limited to the connection of a single beam 12 with a single column 20 or the connection of two diametrically opposed beams 12, 12' with a common column 20. In the non-limiting example of FIG. 7, beams 12 and 12' are connected to column 20 using the beam-column moment connection structure 10 as described above. Additionally, a pair of laterally extending beams 12" and 12'" are also connected to common column 20 using beam-column moment connection structures 10. However, the first and second blocks 22*a*, 22*b* connected to beams 12" and 12'" are mounted on first and second column stiffeners 44, 46, which extend between the first and second column flanges 40, 41, instead of being mounted on the first or second column flanges 40, 41. It should be understood that the beam-column moment connection structure 100 may replace any of the beam-column moment connection structures 10 shown in FIG. 7.

Figure 7:
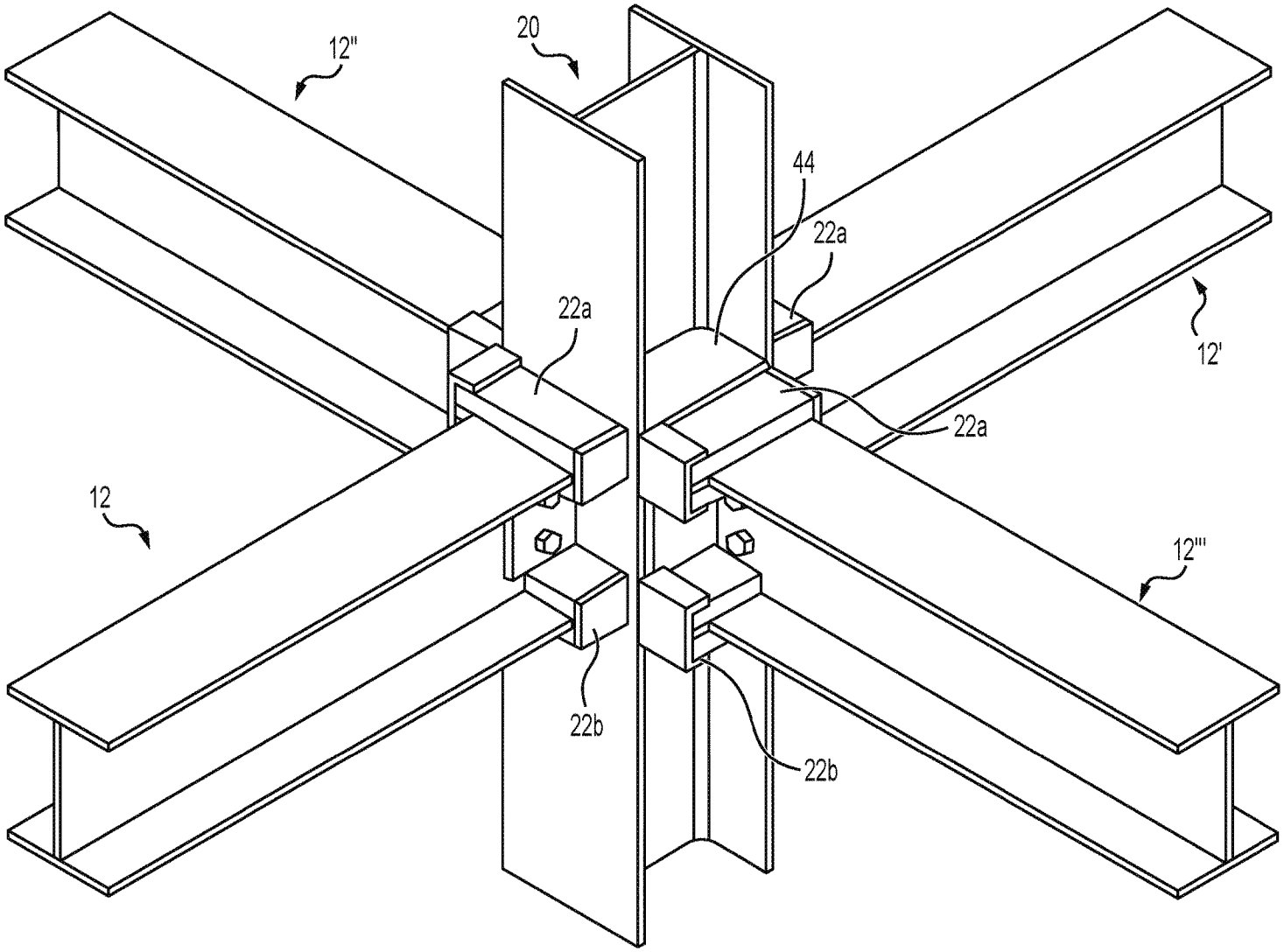
FIG. 7 is a perspective view of four of the beam-column moment connection structures used with one common column.

As best seen in FIGS. 1, 2A and 7, first and second column stiffeners 44, 46 may be attached to the column web 42, the first column flange 40 and the second column flange 41 of column 20. As shown, each of the first and second column stiffeners 44, 46 extends between the first and second column flanges 40, 41 and extends both laterally and longitudinally. As further shown in FIGS. 1 and 2A, the first and second column stiffeners 44, 46 may be positioned adjacent the first and second blocks 22*a*, 22*b*, respectively.

In use, as the shear is transferred through the shear plate 18, the shear strength of the bolted connection should be greater than the shear strength of the beam web 24:

$$nF_{bs} \geq d_w t_w f_y, \tag{1}$$

where $f_y$ is the yield stress of the steel of beam, $t_w$ and $d_w$ are the thickness and the depth of web of the beam, respectively, n is the number of bolts, $F_{bs}$ is the ultimate strength of a bolt, which is the minimum of the bearing and the shearing strength of bolt (i.e., $f_{bb}Øt_w$ and $\pi/4Ø^2 f_{sb}$), Ø is the diameter of bolts, $f_{bb}$ is the bearing strength of bolts, and $f_{sb}$ is the shear strength of bolts.

Figure 9:
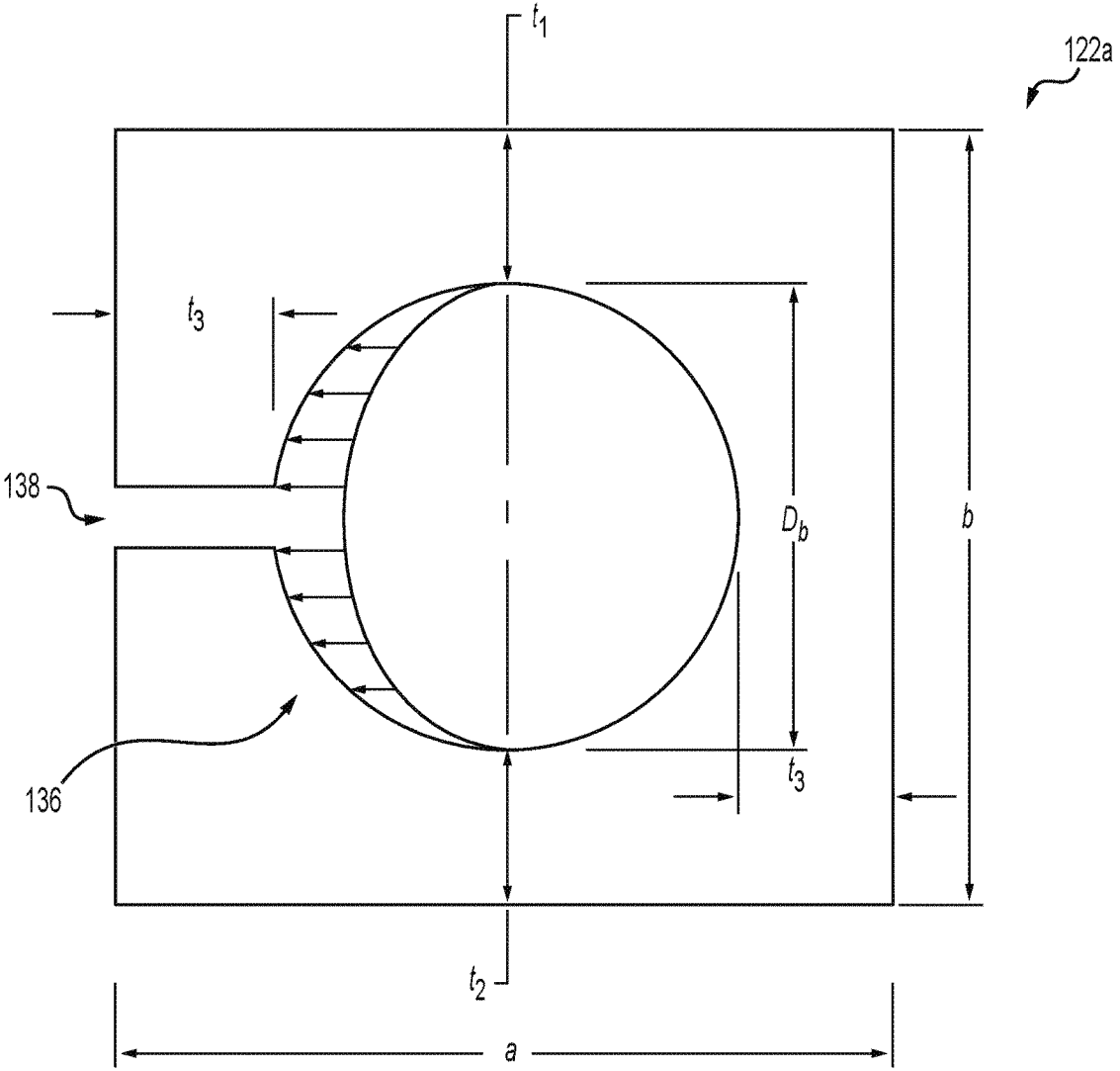
FIG. 9 is a side view of the block of the beam-column moment connection structure of FIG. 5, indicating relative dimensions thereof.

FIG. 9 shows the dimensions of first block 122*a* of the embodiment of FIG. 5 which are of interest for design considerations. The diameter of the cylindrical slot 136, $D_b$, is 2 to 3 times the thickness of upper beam flange 26. The thickness of slot 138 is slightly larger than the thickness of upper beam flange 26. The pull exerted by the beam flange in tension (which may be either at the upper beam flange 26 or the lower beam flange 28, depending upon the nature of bending moment at the joint) applies pressure on the inner surface of the cylindrical slot 136. The moment per unit length caused by these forces at the critical section can be calculated approximately as:

$$M_{fc} = \frac{1}{24} p(D_b - t_f)(4D_b - 4t_f + 3t), \tag{2}$$

where $t_f$ is the thickness of the beam flange, t is the thickness of the critical section of the block, which is equal to $t_1$ or $t_2$, p is the peak pressure applied by the bolt on the inner surface of the cylindrical slot 136, which is given by:

$$p = \frac{2t_f f_y}{(D_b - t_f)}. \tag{3}$$

Substituting the value of p from Eq. (3) into Eq. (2) yields:

$$M_{fc} = \frac{1}{12} t_f f_y (4D_b - 4t_f + 3t). \tag{4}$$

The moment of resistance of the critical section per unit length is given by:

$$M_r = \frac{1}{6} t^2 f_{fb}, \tag{5}$$

where $f_{fb}$ is the allowable flexural (or bending) stress of the block 122*a*. Equating the bending moment at the critical section, given by Eq. (4), to the moment of resistance of the critical section, given by Eq. (5), allows the required thickness of the critical section to be obtained. For economizing the size of the block, the thickness of the critical section can be reduced by providing stiffeners 148, 150. It should be noted that the stiffeners 148 in the upper block 122*a* may be provided on the upper face of the block 122*a*, whereas the stiffeners 150 in the lower block 122*b* may be provided on the lower face of the block 122*b*, as shown in FIG. 5. This is because providing stiffeners on the other face of the blocks will obstruct the beam web 24. The shapes of stiffeners 148, 150 may be rectangular, triangular, trapezoidal or polygonal with curved side. The rectangular stiffeners of FIG. 2B have been found to be more effective in stiffening the block than the triangular stiffeners 148, 150 of FIG. 5. The above analysis was performed for blocks 122*a*, 122*b* of FIG. 5. For blocks 22*a*, 22*b* of FIG. 1, the size of the blocks 22*a*, 22*b* can be considerably reduced to achieve even better performance.

Returning to FIG. 9, the thickness $t_3$ can be taken as equal to the lesser of the two thicknesses, $t_1$ and $t_2$. The dimension of the cross-section of the block is a×b, where $a=D_b+2t_3$, and $b=D_b+t_1+t_2$. The size of weld between the block 122*a* and the first column flange 40 should be selected so that it is able to transfer the tensile force from the beam flanges 26, 28 to the column 20 safely.

Figure 8:
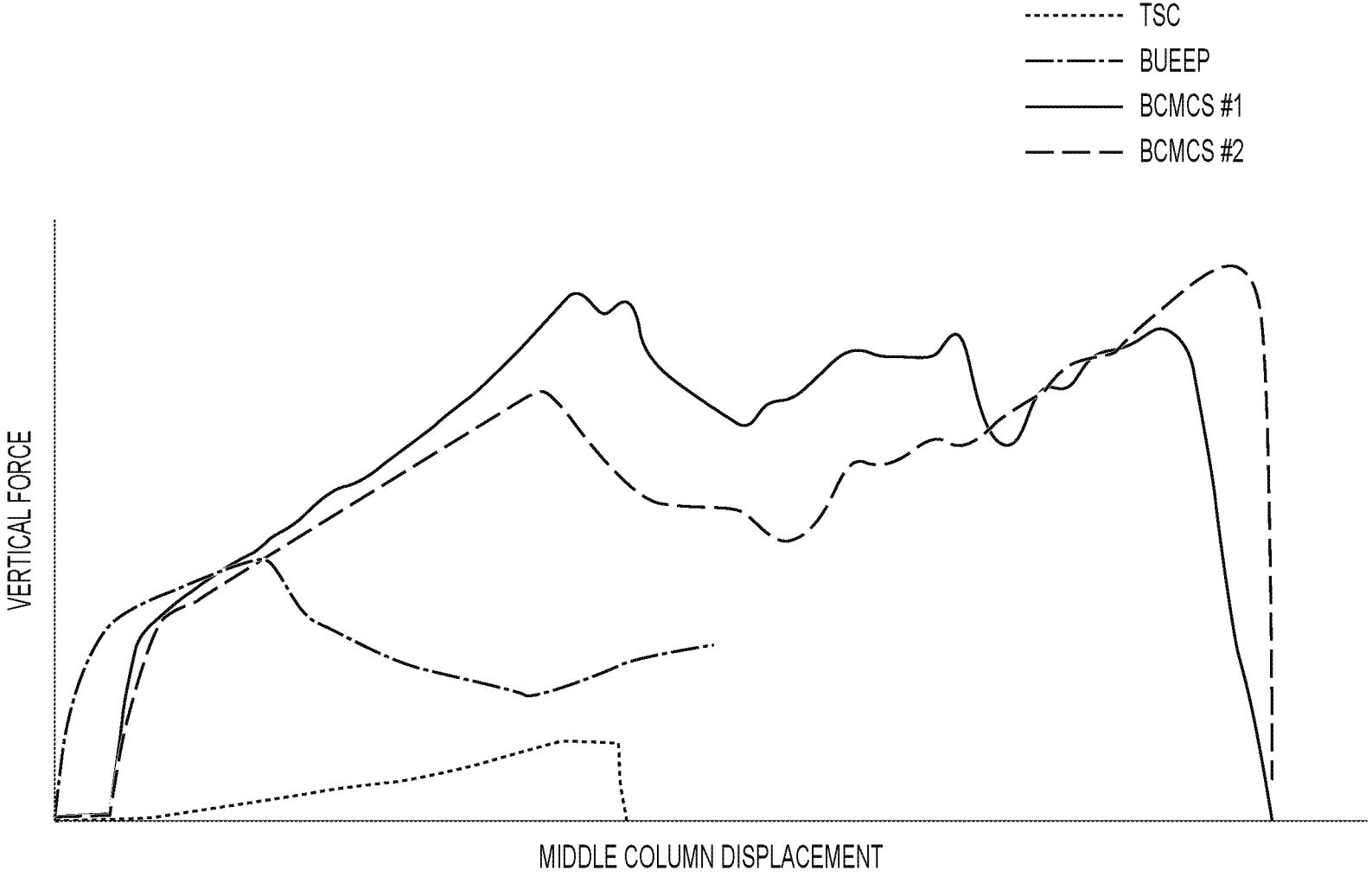
FIG. 8 is a graph comparing load displacement of the beam-column moment connection structure (BCMCS) of FIG. 1, the beam-column moment connection structure (BCMCS) of FIG. 5, a traditional shear connection (TSC), and a conventional bolted unstiffened extended end-plate (BUEEP) moment connection.

FIG. 8 is a graph comparing load displacement of the beam-column moment connection structure 10 (BCMCS #1) with rectangular stiffeners 48, 50, the beam-column moment connection structure 100 of FIG. 5 (BCMCS #2) with triangular stiffeners 148, 150, a traditional shear connection (TSC), and a conventional bolted unstiffened extended end-plate (BUEEP) moment connection.

Figure 10B:
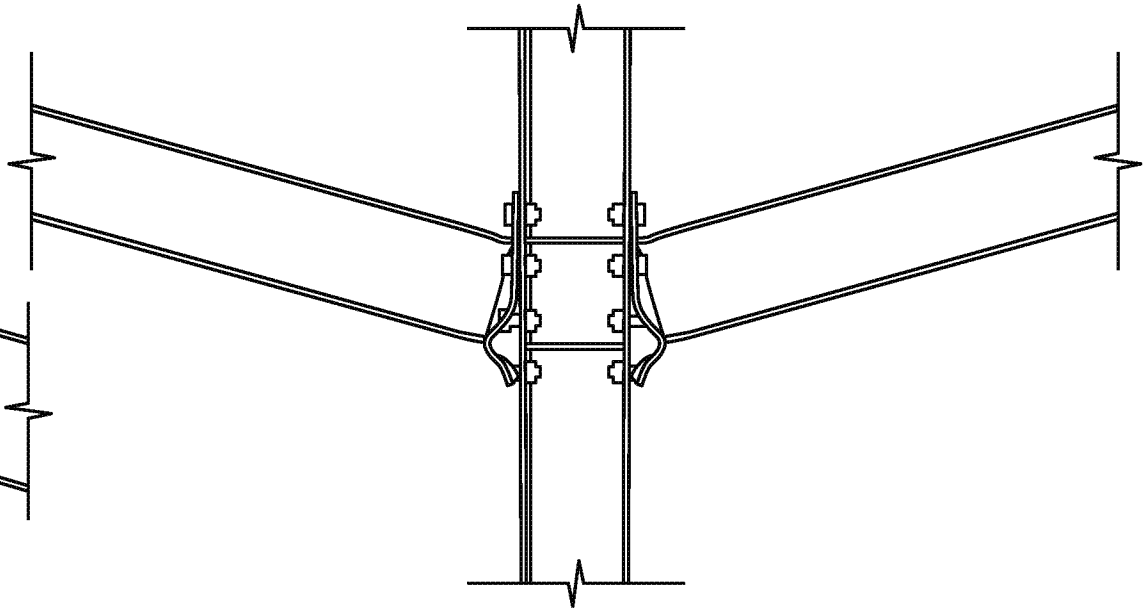
FIG. 10B PRIOR ART
FIG. 10B illustrates progressive collapse in the beam-column frame with the traditional shear connection, particularly showing failure of an interior joint.
Figure 10A:
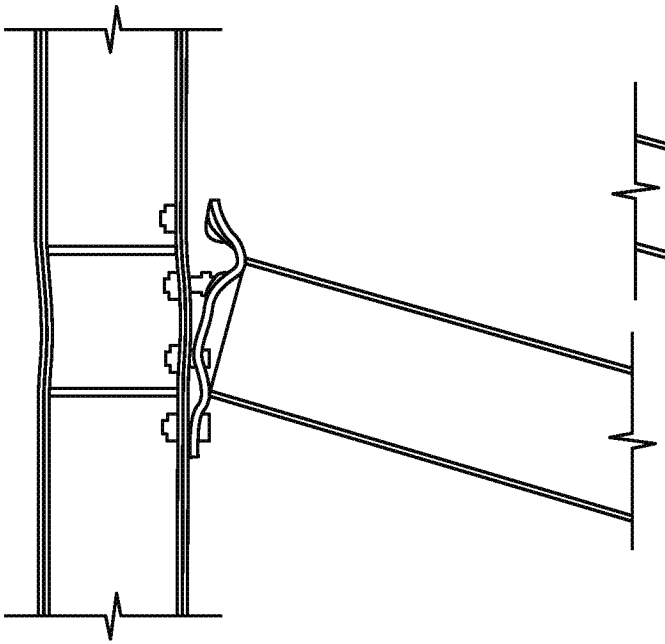
FIG. 10A PRIOR ART
FIG. 10A illustrates progressive collapse in a beam-column frame with a traditional shear connection, particularly showing failure of an exterior joint.
Figure 11B:
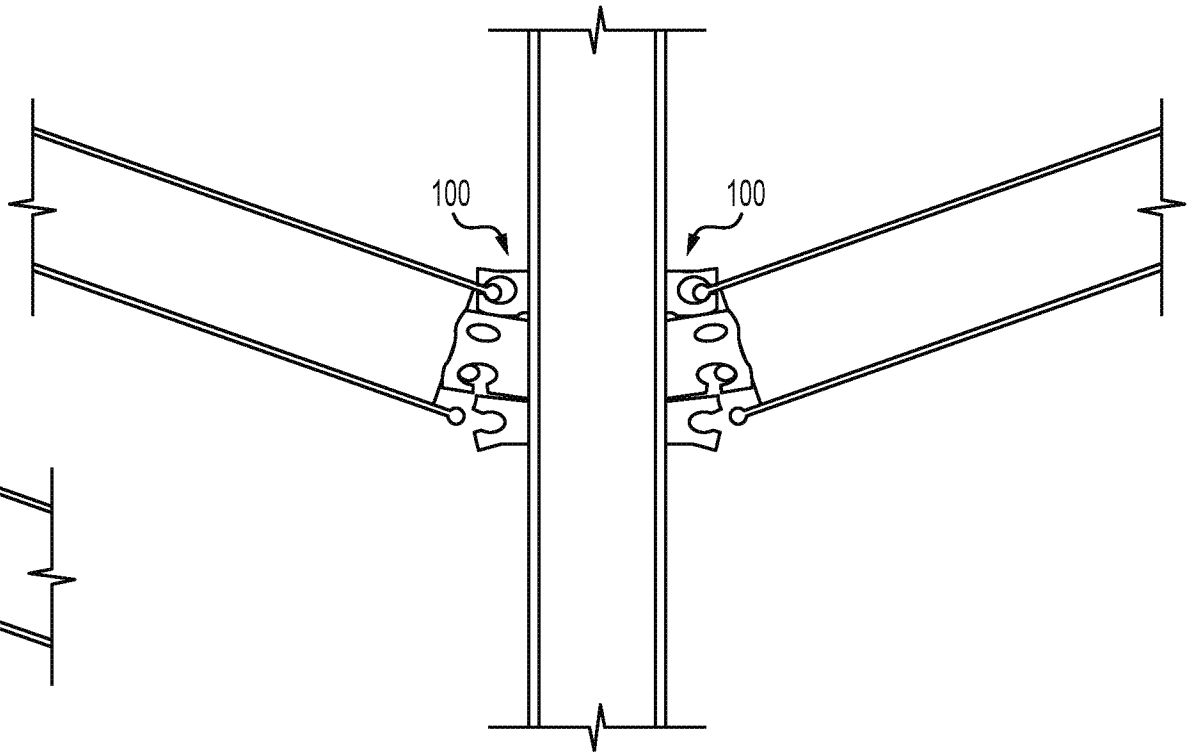
FIG. 11B illustrates progressive collapse in the beam-column frame with the beam-column moment connection structure of FIG. 5, particularly showing failure of an interior joint.
Figure 11A:
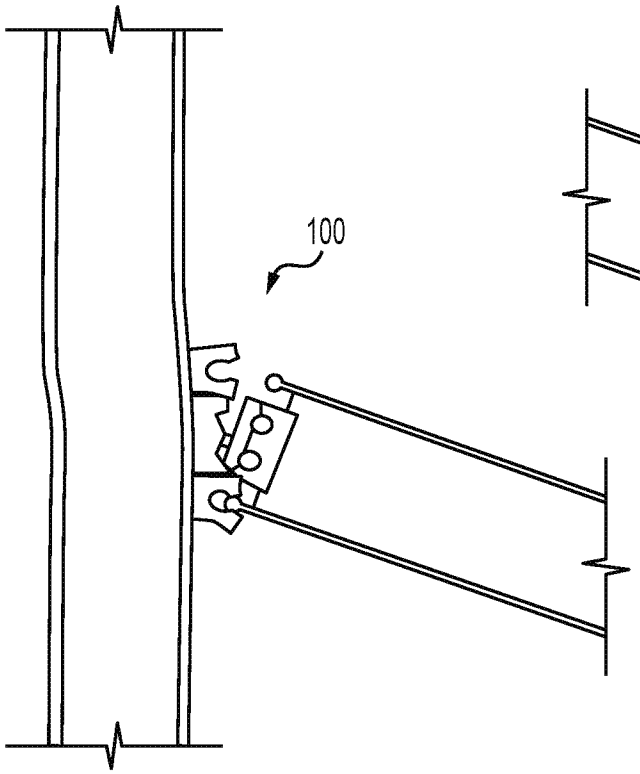
FIG. 11A illustrates progressive collapse in a beam-column frame with the beam-column moment connection structure of FIG. 5, particularly showing failure of an exterior joint.

The traditional shear connection has poor resistance against progressive collapse because the bolts used for the transfer of shear force from beam to column are also used for resisting progressive collapse. FIGS. 10A and 10B illustrate progressive collapse in a traditional shear connection, with FIG. 10A showing failure of an exterior joint and FIG. 10B shown failure of an interior joint. In contrast, as shown in FIGS. 11A and 11B and in the results of FIG. 8, the beam-column moment connection structure 100 has much better performance because the transfer of beam loads to the column is through the bolt head, whereas the progressive collapse is resisted by the resistance provided by the block resisting the bolt coming out of the slot. The magnitude of resistance against progressive collapse provided by the present beam-column moment connection structure depends on its design. Returning to FIG. 8, it can be seen that the present beam-column moment connection structure provides substantially higher resistance against progressive collapse. FIG. 8 also shows the results of analysis of the connection structure with rectangular stiffeners 48, 50 (of FIG. 2B) with uniform spacing. It can be seen that the use of stiffeners causes substantial enhancement in progressive collapse resistance. Further improvement in progressive collapse resistance can be achieved through the use of stiffeners at close spacing near the top and bottom and/or increasing the number of stiffeners.

It is to be understood that the beam-column moment connection structure is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A beam-column moment connection structure, comprising:

a beam having a beam web, an upper beam flange and a lower beam flange, the beam having first and second longitudinally opposed ends;

a first bolt secured to the upper beam flange at the second end of the beam, wherein the first bolt extends laterally, and wherein a lateral direction is perpendicular to a longitudinal direction;

a second bolt secured to the lower beam flange at the second end of the beam, wherein the second bolt extends laterally;

a column having a column web, a first column flange and a second column flange;

a first block having a laterally extending first slot formed therein, the first block being secured to an exterior face of the first column flange; and a second block having a laterally extending second slot formed therein, the second block being secured to the exterior face of the first column flange, wherein the first block is adapted to receive the first bolt in the first slot, and wherein the second block is adapted to receive the second bolt in the second slot to secure the beam to the column.

2. The beam-column moment connection structure as recited in claim 1, wherein the first bolt and the second bolt are each cylindrical bolts.

3. The beam-column moment connection structure as recited in claim 2, wherein the first and second laterally extending slots are each cylindrical slots.

4. The beam-column moment connection structure as recited in claim 3, wherein each of the first and second blocks further has a longitudinally extending slot in open communication with the corresponding one of the first and second laterally extending slots.

5. The beam-column moment connection structure as recited in claim 1, wherein the beam web has first and second recesses formed therein at the second end of the beam for partially receiving the first and second blocks, respectively.

6. The beam-column moment connection structure as recited in claim 1, further comprising:

at least one first stiffener plate secured to the first column flange and the first block; and at least one second stiffener plate secured to the first column flange and the second block.

7. The beam-column moment connection structure as recited in claim 6, wherein each of the at least one first stiffener plate and the at least one second stiffener plate has a rectangular contour.

8. The beam-column moment connection structure as recited in claim 6, wherein each of the at least one first stiffener plate and the at least one second stiffener plate has a triangular contour.

9. The beam-column moment connection structure as recited in claim 1, further comprising a shear plate secured to the first column flange and extending longitudinally therefrom, the shear plate being adapted for attachment to the beam web at the second end of the beam.

10. The beam-column moment connection structure as recited in claim 1, further comprising first and second locking members for locking the first and second bolts in the first and second slots, respectively.

11. The beam-column moment connection structure as recited in claim 10, wherein each of the first and second blocks has laterally opposed first and second ends, the first end being open and the second end being closed.

12. The beam-column moment connection structure as recited in claim 11, wherein upper and lower lips are respectively formed on upper and lower portions of the first end of each of the first and second blocks.

13. The beam-column moment connection structure as recited in claim 12, wherein each of the first and second locking members has a substantially C-shaped contour for receiving and mating with the first end and the upper and lower lips of each of the first and second blocks.

14. The beam-column moment connection structure as recited in claim 1, further comprising at least one column stiffener attached to the column web, the first column flange and the second column flange of the column, wherein the at least one column stiffener extends between the first and second column flanges, and wherein the at least one column stiffener extends both laterally and longitudinally.

15. The beam-column moment connection structure as recited in claim 14, wherein the at least one column stiffener comprises first and second column stiffeners.

16. The beam-column moment connection structure as recited in claim 15, wherein the first and second column stiffeners are positioned adjacent the first and second blocks, respectively.

17. The beam-column moment connection structure as recited in claim 1, wherein the first and second bolts and the corresponding first and second slots have a taper.

* * * * *